United States Patent [19]

Blakeway

[11] Patent Number: 4,550,538

[45] Date of Patent: Nov. 5, 1985

[54] POOL AND METHOD OF MAKING SAME

[75] Inventor: Stanley R. Blakeway, Stafford, Australia

[73] Assignee: Blakeway Marviroll Pools Pty. Ltd., Queensland, Australia

[21] Appl. No.: 474,580

[22] PCT Filed: Jul. 29, 1982

[86] PCT No.: PCT/AU82/00119

§ 371 Date: Mar. 1, 1983

§ 102(e) Date: Mar. 1, 1983

[87] PCT Pub. No.: WO83/00521

PCT Pub. Date: Feb. 17, 1983

[30] Foreign Application Priority Data

Jul. 29, 1981 [AU] Australia ..... PE9976

[51] Int. Cl.[4] ..... E04H 3/16

[52] U.S. Cl. ..... 52/169.7; 52/742; 52/247; 264/31; 264/34; 4/506; 4/513

[58] Field of Search ..... 52/169.7, 741, 742, 52/98, 288, 247; 264/35, 31, 34, 261, 333; 249/35, 61, DIG. 3; 4/506, 513

[56] References Cited

U.S. PATENT DOCUMENTS

| | | | |
|---|---|---|---|
| 2,873,505 | 2/1959 | Sheldon | 264/34 |
| 3,439,362 | 4/1969 | Goettl | 4/506 |
| 3,468,088 | 9/1969 | Miller | 4/506 X |
| 3,486,289 | 12/1969 | Lavack | 52/247 |
| 3,631,545 | 1/1972 | Orndorff . | |
| 3,833,944 | 9/1974 | Goettl et al. | 4/506 X |
| 3,930,346 | 1/1976 | Blakeway . | |
| 4,078,354 | 3/1978 | Crowley | 52/247 |
| 4,227,361 | 10/1980 | Miller | 52/169.7 |
| 4,306,794 | 12/1981 | Blakeway . | |

FOREIGN PATENT DOCUMENTS

| | | |
|---|---|---|
| 431788 | 2/1973 | Australia . |
| 55429 | 8/1980 | Australia . |
| 0004144 | 9/1979 | European Pat. Off. . |
| 2152072 | 9/1972 | France . |
| 1072800 | 6/1967 | United Kingdom . |

*Primary Examiner*—J. Karl Bell
*Assistant Examiner*—Creighton Smith
*Attorney, Agent, or Firm*—Schwartz, Jeffery, Schwaab, Mack, Blumenthal & Evans

[57] ABSTRACT

A liquid storage container, such as a swimming pool, has a vertical wall of flexible sheet material with its ends joined to make an endless loop the bottom part of which is inserted in an endless groove in a concrete foundation. The groove is formed by casting in the concrete an endless base strip, preferably metal, and a former strip of rubber or like material fitted about the base strip and extending above it, concrete within the bounds of the base strip being level with the top of the base strip, concrete outside the former strip being at the higher level of this strip which, when the concrete has set, is stripped away to leave the groove, the base strip forming its inside face, its higher outside face being a shoulder assisting the insertion of the wall bottom. A sealing strip is force-fitted between the inside face of the groove and the inserted bottom of the wall. The container bottom may be covered with a pliable water-impervious liner with its periphery inserted into the groove and held by the sealing strip.

6 Claims, 5 Drawing Figures

POOL AND METHOD OF MAKING SAME

BACKGROUND OF THE INVENTION

This invention relates to a pool or other liquid storage container and method of making the same.

A known type of swimming or ornamental pool has a substantially flat bottom, which may be of free-form shape, made of sheet material, and having secured and sealed about its periphery an extruded metal section formed with a horizontal groove to receive the edge of the pool bottom and also a sealing strip, and also formed with a vertical groove to receive the bottom edge of the wall of the pool. The pool wall consists of a section of pliable sheet material which may be rolled up for delivery to the site, and of which the ends are then secured together to form an endless loop. The bottom edge of the wall section is sealed in the vertical groove of the extrusion about the periphery of the pool bottom by a round-section sealing strip driven between a side of the groove and the inserted part of the wall. The pool bottom is bedded on sand, an extruded stiffening strip is applied about the top of the pool wall, and concrete is poured about the pool wall, within the excavation for the pool.

Pools of this type have been generally satisfactory, being capable of being made in a very wide variety of configurations in plan view. A disadvantage has been found in difficulties experienced in bending to shape the extrusion applied about the periphery of the pool bottom while retaining its cross-sectional configuration undistorted, and particularly in maintaining the sides of both the horizontal and the vertical groove consistently parallel and uniformly spaced.

The present invention has been devised with the general object of providing a pool or other liquid storage container having a similar flexibility of contour, but which is particularly simple and economical to make and install.

BRIEF SUMMARY OF THE INVENTION

Accordingly, the invention resides broadly in a method of making a pool or other liquid storage container including the steps of supporting an endless base strip with its upper edge substantially in a horizontal plane; applying an endless former strip of resiliently deformable material about the base strip, the top of the former strip being above the top of the base strip; applying concrete to embed therein the base and former strips, concrete inwardly of the base strip being substantially level with the top of this strip, concrete outwardly of the former strip being above the level of the base strip; removing the former strip after the concrete has set to form an endless groove of which the base strip forms the inside face; inserting into this groove the bottom part of a container wall consisting of an endless loop of vertical sheet material; and force-fitting a sealing strip of resiliently deformable material into the groove between the base strip and the inserted bottom part of the wall. The invention also resides in a pool or other storage container made according to the method above set out.

DETAILED DESCRIPTION OF THE PREFERRED EMBODIMENT

The pool illustrated is of in-ground type, and an excavation is made somewhat larger than the contour of the pool to be installed, the excavation having a substantially flat level bottom.

An extruded metal base strip, of aluminium for example, has its ends connected to form an endless loop which is shaped to the configuration of the pool to be made and is supported above the excavation bottom by blocks 11 so that it is level. The base strip 10 is disposed vertically, and it is formed with an integral longitudinal stop bead 12 extending from its outer face, nearer to its bottom than to its top.

Figure 1:
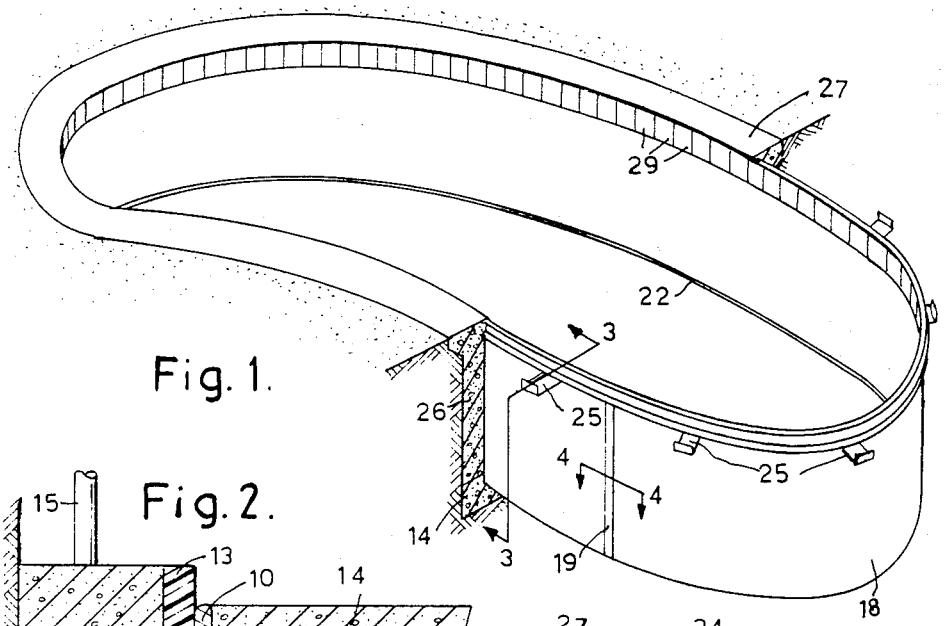
FIG. 1 is a partly broken-away perspective view of a pool according to the invention.
Figure 2:
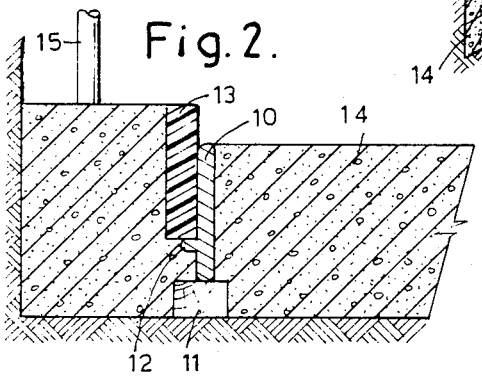
FIG. 2 is a sectional view to larger scale of a part of the pool during the course of its construction.
Figure 3:
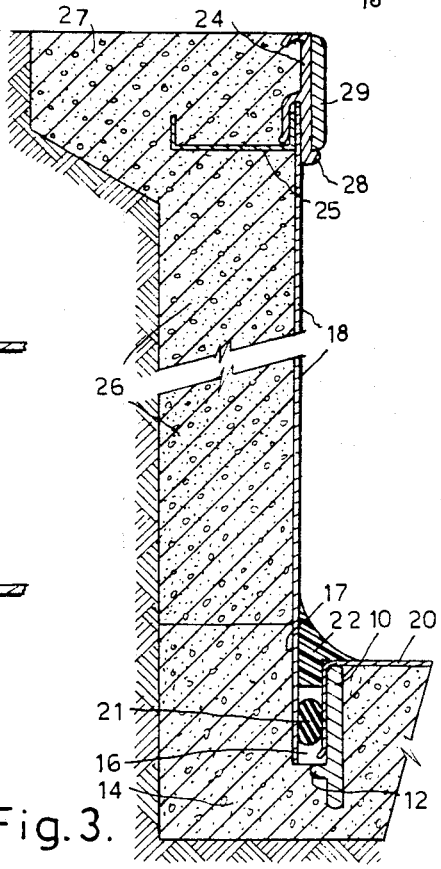
FIG. 3 is a sectional view to the same scale as FIG. 2, taken along line 3—3 in FIG. 1.

A former strip 13 of resiliently deformable material such as rubber is fitted, as an endless loop, about the base strip 10, as shown in FIG. 2, the former strip being parallel sided, resting on the stop bead 12 of the base strip 10, and extending above the top of the base strip.

A reinforced concrete foundation 14 is poured within the loop of the base strip 10, and is screeded to the level of the top of this strip. The concrete is also poured outside the former strip 13, to the higher level of the top of this strip. Reinforcing steel rods 15 extend up from this outer and higher part of the concrete foundation.

When the concrete has sufficiently set, the former strip 13 is stripped away from the concrete, to leave an endless vertical groove 16, of which the inside face is formed by the smooth imperforate outer face of the base strip 10, the higher level of concrete outwardly of the groove forming an endless shoulder 17 about the outside of the groove 16.

The wall 18 of the pool consists of an endless loop of sheet material such as galvanized sheet steel with both sides coated with polyvinyl chloride. The pool wall may be a parallel-sided length of this material rolled for convenient transport, unrolled at the pool site and set with its bottom edge portion within the groove 16 to determine the length to which the wall section is to be cut, after which the ends of the wall section are secured together in sealed manner to form an endless loop.

Figure 4:
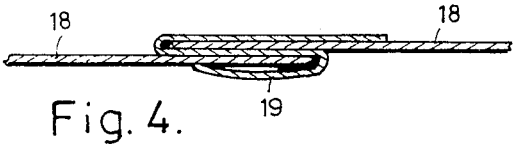
FIG. 4 is a sectional view, to further enlarged scale, along line 4—4 in FIG. 1, showing the sealed connection of the ends of the pool wall section.
Figure 5:
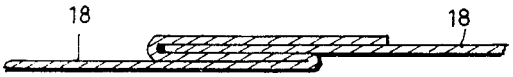
FIG. 5 is a sectional view showing an alternative sealed connection of the ends of the pool wall section.

Alternative methods of securing together the ends of the wall 18 of the pool are shown in FIGS. 4 and 5. As shown in FIG. 4, a connector piece 19 of, for example, sheet stainless steel may be used, a strip of this material being formed with two parallel longitudinal bends in opposite directions so that, in cross-section, the strip is of flattened S or flattened zig-zag form to provide two deep but narrow channels opening from opposite sides of the connector. After any suitable mastic has been introduced to these channels the two ends of the wall 18 are forced into them. In the alternative form shown in FIG. 5, one end portion of the wall 18 is doubled over and then bent over through a sharp U-bend in opposite direction to form a deep but narrow channel into which the other end portion of the wall section is driven after the insertion of mastic to the channel.

The wall 18, with its ends joined as described, is installed with its bottom part in the groove 16, lying against the outer or concrete face of this groove. The provision of the shoulder 17 about the groove 16 very greatly facilitates the engagement of the bottom part of the wall 18 in the groove 16.

If the concrete bottom 14 is not adequately impervious to water, a liner 20 of pliable sheet material such as vinyl sheeting, cut to required form, is laid over the concrete pool bottom and its edge portion is inserted into the groove 16, after which a round-section sealing strip 21 of rubber or other suitable resiliently deformable material is driven into the groove 16, being compressed or somewhat flattened between the inserted parts of the wall 18 and the bottom liner 20 to effect a water-tight seal between the two.

If the concrete bottom 14 of the pool is water-impervious, the liner 20 may be omitted, the sealing strip 21 being driven between the inserted bottom part of the wall 18 and the strip 10.

In either case, an extruded finishing strip 22 of resiliently deformable material is applied to the junction of the pool wall and pool bottom, being shaped to engage in the upper part of the groove 16 and to fair smoothly to the pool bottom and wall.

An extruded top edging strip 24 is engaged and levelled on the top of the pool wall 18, this strip being divided from below to grip the wall top. At intervals, channelled metal retaining pieces 25 have their inner flanges driven into the division of the top edging strip so the pieces 25 extend outwardly from the upper part of the pool wall.

With the pool being progressively filled with water, concrete as indicated at 26 is poured into the excavation about the pool wall 18, the retaining pieces 25 being enclosed in this concrete which, at the top, forms a coping 27.

The top edging strip 24 is formed at the bottom of its inside face with a bead 28 to assist in aligning and supporting tiles 29 secured adhesively to the top edging piece.

The invention is applicable to an above-ground pool, in which case the wall 18 is reinforced by any suitable supporting means.

Instead of concrete being poured completedy across the pool bottom, the foundation may be an endless strip or loop of concrete, formed as before described and as illustrated by a groove 16 to receive the pool wall and periphery of the bottom liner which, within the foundation, may be supported on a bed of sand. In an in-ground or above-ground pool, the pool bottom may be dished or concave.

The invention is applicable to liquid storage containers other than swimming, bathing or ornamental pools, for example to water storage tanks, which may be of in-ground or above-ground type. Such a tank will, of course, normally be of cylindrical shape rather than the free-form configuration illustrated.

Pools or other liquid storage containers according to the invention will be bound to be very effective in achieving the objects for which they have been devised. All of the main components of such a unit may be readily transported to the required site and the installation may be carried out quickly and economically without highly skilled labour being required.

I claim:

1. A method of making a liquid storage container including the steps of:

supporting an endless base strip with its upper edge substantially in a horizontal plane;

applying an endless former strip of resiliently deformable material about the base strip, the top of the former strip being above the top of the base strip;

applying concrete to embed therein the base and former strips, concrete inwardly of the base strip being substantially level with the top of said base strip, concrete outwardly of the former strip being above the level of the base strip;

removing the former strip after the concrete has set to form an endless groove of which the base strip forms the inside face;

inserting into said groove the bottom part of a container wall consisting of an endless loop of vertical sheet material; and force-fitting a sealing strip of resiliently deformable material into said groove between the base strip and the inserted bottom part of said wall.

2. A method according to claim 1 and including the further step of:

placing a bottom liner of pliable water-impervious sheet material within the bounds of the base strip and inserting its peripheral part into said groove prior to the force-fitting of said sealing strip.

3. A liquid storage container including:

a concrete bottom;

an endless groove formed in the concrete bottom, its inside face defined by a base strip of longitudinally flexible material at least partly embedded in the concrete bottom, its outside face extending upwardly above the level of its inside face;

an endless wall section of vertically disposed flexible sheet material, its bottom part inserted within the groove and adjacent to the outside face thereof; and a sealing strip of resiliently deformable material force-fitted in the groove between the inside face thereof and the inserted bottom part of the wall.

4. A liquid storage container according to claim 3 wherein:

a bottom liner of water-impervious pliable sheet material is provided, having its peripheral part inserted into the groove adjacent to the base strip, the sealing strip exerting pressure against the inserted part of the bottom liner and the inserted part of the wall.

5. The method of claim 2 further including the step of compressively inserting an endless finishing strip of resiliently deformable material into the top of said groove above said sealing strip, said finishing strip being shaped to resiliently engage the top surface of said bottom liner and the adjacent surface of said container wall.

6. The container of claim 4, further including an endless finishing strip compressively inserted in the top of said groove thereby closing the same, said finishing strip being shaped to resiliently engage the top surface of said bottom line and the adjacent surface of said endless wall section.

* * * * *